US005713403A

United States Patent [19]

Clüsserath et al.

[11] Patent Number: 5,713,403

[45] Date of Patent: Feb. 3, 1998

[54] METHOD AND SYSTEM FOR FILLING CONTAINERS WITH A LIQUID FILLING PRODUCT, AND FILLING MACHINE AND LABELLING DEVICE FOR USE WITH THIS METHOD OR SYSTEM

[75] Inventors: Ludwig Clüsserath, Bad Kreuznach; Jean Marti, Kleve; Klaus-Werner Jung, Weiterstadt, all of Germany

[73] Assignee: KHS Maschinen- und Anlagenbau Aktiengesellschaft, Dortmund, Germany

[21] Appl. No.: 628,259

[22] Filed: Apr. 5, 1996

[30] Foreign Application Priority Data

Apr. 7, 1995 [DE] Germany ..... 195 13 064.2

[51] Int. Cl.[6] ..... B65C 9/00

[52] U.S. Cl. ..... 141/101; 141/9; 141/104; 141/129; 141/145; 156/567

[58] Field of Search ..... 141/9, 100, 101, 141/104, 129, 144, 145; 156/567

[56] References Cited

U.S. PATENT DOCUMENTS

| | | | |
|---|---|---|---|
| 1,621,470 | 3/1927 | Shields | 141/104 X |
| 2,638,259 | 5/1953 | Garrett | 141/101 |
| 2,723,042 | 11/1955 | Banks | 156/567 X |
| 4,362,594 | 12/1982 | Nagano et al. | 156/567 |
| 4,594,123 | 6/1986 | Eder | 156/567 X |
| 4,713,925 | 12/1987 | Kafkis | 53/432 |
| 5,163,484 | 11/1992 | Howlett et al. | 141/9 |
| 5,326,422 | 7/1994 | Kronseder | 156/567 X |

*Primary Examiner*—J. Casimer Jacyna

*Attorney, Agent, or Firm*—Nils H. Ljungman and Associates

[57] ABSTRACT

The consumer, and in particular the beverage consumer, frequently demands different packaging units which consist of different beverages or different assortments of beverages. That means that packaging units must be assembled which contain, for example, two bottles of a carbonated fruit-flavor beverage and four bottles of a beverage containing cola. The labelling and other packaging of the container must correspond to the product In the individual container. The packaging units are generally assembled either manually or semi-automatically. The invention relates to a method which simplifies the preparation of packaging units which contain different filling products. The invention is characterized by the fact that to fill the containers according to a Specified or selected filling formation with different filling products, i.e. optionally with at least a first or a second filling product, the filling machine is controlled by a control device so that, as a function of the filling formation, the filling positions dispense different products into containers which are unique and appropriate to each product.

18 Claims, 5 Drawing Sheets

METHOD AND SYSTEM FOR FILLING CONTAINERS WITH A LIQUID FILLING PRODUCT, AND FILLING MACHINE AND LABELLING DEVICE FOR USE WITH THIS METHOD OR SYSTEM

BACKGROUND OF THE INVENTION

1. Field of the Invention

This invention generally relates to a method for filling liquid products, in particular beverages, into bottles, cans or similar containers.

This invention also relates to a system for filling the liquid filling product.

This invention also relates to a filling machine for use with the method or system for filling liquid filling product, and to a labelling device for use with the method or system for filling the liquid filling product.

2. Background Information

The consumer, and in particular the beverage consumer, frequently demands different packaging units (e.g. cartons of three, six or twelve containers) which contain different beverages, in different numbers, different filling formations or different assortments. In practice, that means that packaging units must be assembled which contain, for example, two bottles of a carbonated fruit-flavor beverage and four bottles of a beverage containing cola. The type of container and the closing are thereby identical for the different products. The labelling or additional packaging of the container, however, must correspond to the respective product contained, and differs from product to product.

To meet this requirement, the known systems include systems which make it possible to assemble the packaging units from inventory manually or semi-automatically. This known method not only requires an additional expenditure of manpower, since the bottled or canned product must first be placed in storage in the warehouse and then taken out of the warehouse again, but the known method also means that to obtain the desired packaging units which contain at least two different products, two batches must be bottled or canned at two different times.

OBJECT OF THE INVENTION

The object of the invention is to create a method, an apparatus, and a system which simplifies the preparation of packaging units which contain different filling products.

SUMMARY OF THE INVENTION

The invention teaches that this object can be accomplished by means of a method and a system. A method, wherein, to fill the containers with different filling products, i.e. optionally with at least a first or a second filling product according to a specified or selected filling formation, the filling machine is preferably controlled by means of a control device so that the filling positions fill the different filling products into the appropriate containers for each filling product according to the filling formation. A system, wherein, to fill the containers with different filling products, i.e. optionally with at least a first or a second filling product according to a specified or selected filling formation, the filling machine can be preferably controlled by means Of a control device so that the filling positions fill the different filling products into the appropriate containers for each filling product according to the filling formation.

The invention teaches a filling machine for use in this method or system, wherein to fill the containers according to a specified or selected filling formation optionally with at least a first or a second filling product, the filling machine can preferably be controlled by means of a control device so that according to the filling formation, different filling positions or groups of filling positions dispense different filling products into suitable containers for each filling product.

The invention also teaches a labelling device for use in this method or system, wherein to label containers which are filled in a specified or selected filling formation, each of which may be filled with a different filling product, and are preferably transported in this formation to the labelling device, the at least one labelling station can be activated by a control device to label the containers in a manner which corresponds to the filling formations, so that each container is labelled with the label which corresponds to its contents.

In accordance with the invention, the desired filling formation can be selected or specified on a central control device (process computer). The process control then first controls the filling machine according to these instructions, so that the filling machine fills the corresponding containers in the filling formation with different filling product or contents, namely, each product in its own appropriate container. The filling positions can therefore form groups, for example, the number of groups equaling the number of the different products, whereby the filling positions of each group dispense a product into the corresponding containers as the rotor revolves. The number of filling positions in each group is also preferably defined by the control device, as a function of the desired or selected filling formation.

In one preferred embodiment of the invention, each filling position and the filling element located in it, has a connection for each product which leads to a supply line or a reservoir for this product, and has a switch valve device so that, under the control of the central control device, and as a function of the desired or selected filling formation, the respective filling position and the filling element located in it can be connected to the connection which corresponds to the product required.

One essential advantage of the invention is that the containers required for the packaging units to be manufactured can be filled with the required products during one filling process, i.e. it is no longer necessary to store the products in the warehouse even temporarily, which saves not only time and money, but also frees up warehouse space.

When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments illustrated in the accompanying drawings, in which.

DESCRIPTION OF THE PREFERRED EMBODIMENT

Figure 1:
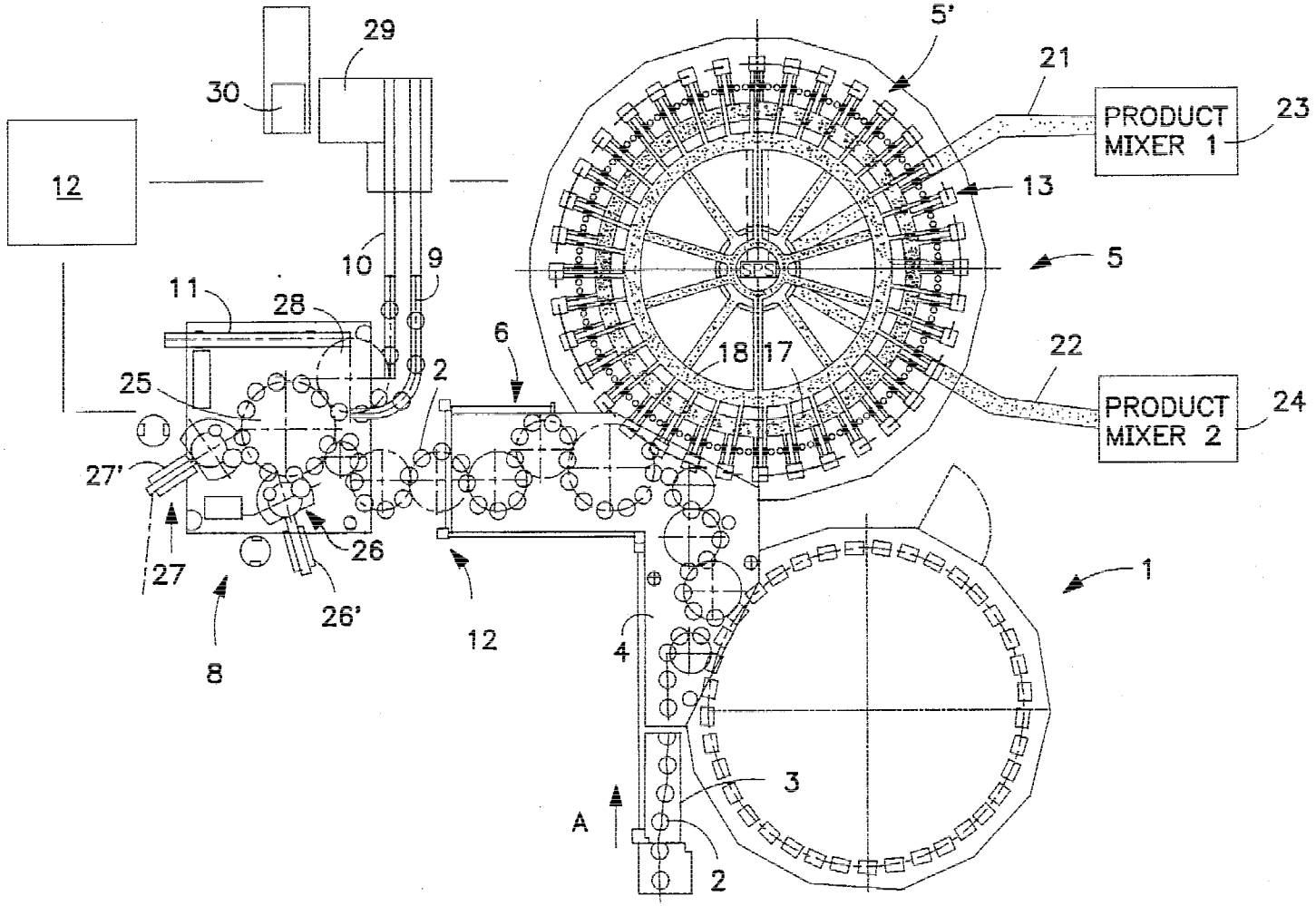
FIG. 1 shows a simplified overhead view of a system for the simultaneous filling, closing and subsequent labelling of containers, namely bottles, with two different products.

FIG. 1 shows a rinser 1, to which the containers, namely bottles 2, are fed in the direction indicated by the arrow A by means of a conveyor line 3, and downstream of which, in the direction of travel, the rinsed bottles 2 are transported by means of a conveyor line 4 formed by a star wheel conveyor to a filling machine 5 or its inlet star wheel. Downstream of the filling machine 5, in the direction of travel of the bottles 2, there can preferably be a closer 6 which closes the bottles 2. The closer 6 can be connected directly to a labelling device 8 by means of a conveyor line 7 formed by a plurality of star wheel conveyors. In the illustrated embodiment, the labelling machine has three outputs, namely one output formed by a conveyor 9 for bottles 2 which are filled with a first product, and are then labelled corresponding to this product, a second output formed by a conveyor 10 for those bottles 2 which are filled with a second product and are then labelled corresponding to this product, and a third output formed by a conveyor 11 which removes any bottles 2 which have been incorrectly labelled.

As also shown in the accompanying figures, the rinser 1, the filling machine 5 and the closer 6 form a common block of machines which has a common bottling table.

In the figures, 12 is a central electronic control device which includes a process controller which, among other things, controls the operation of the above-referenced system which is described in greater detail below.

The following comments relate to the individual components of the system:

Rinser 1

The rinser has the conventional construction and operation with which a technician skilled in the art would be familiar.

Filling Machine 5

Figure 2:
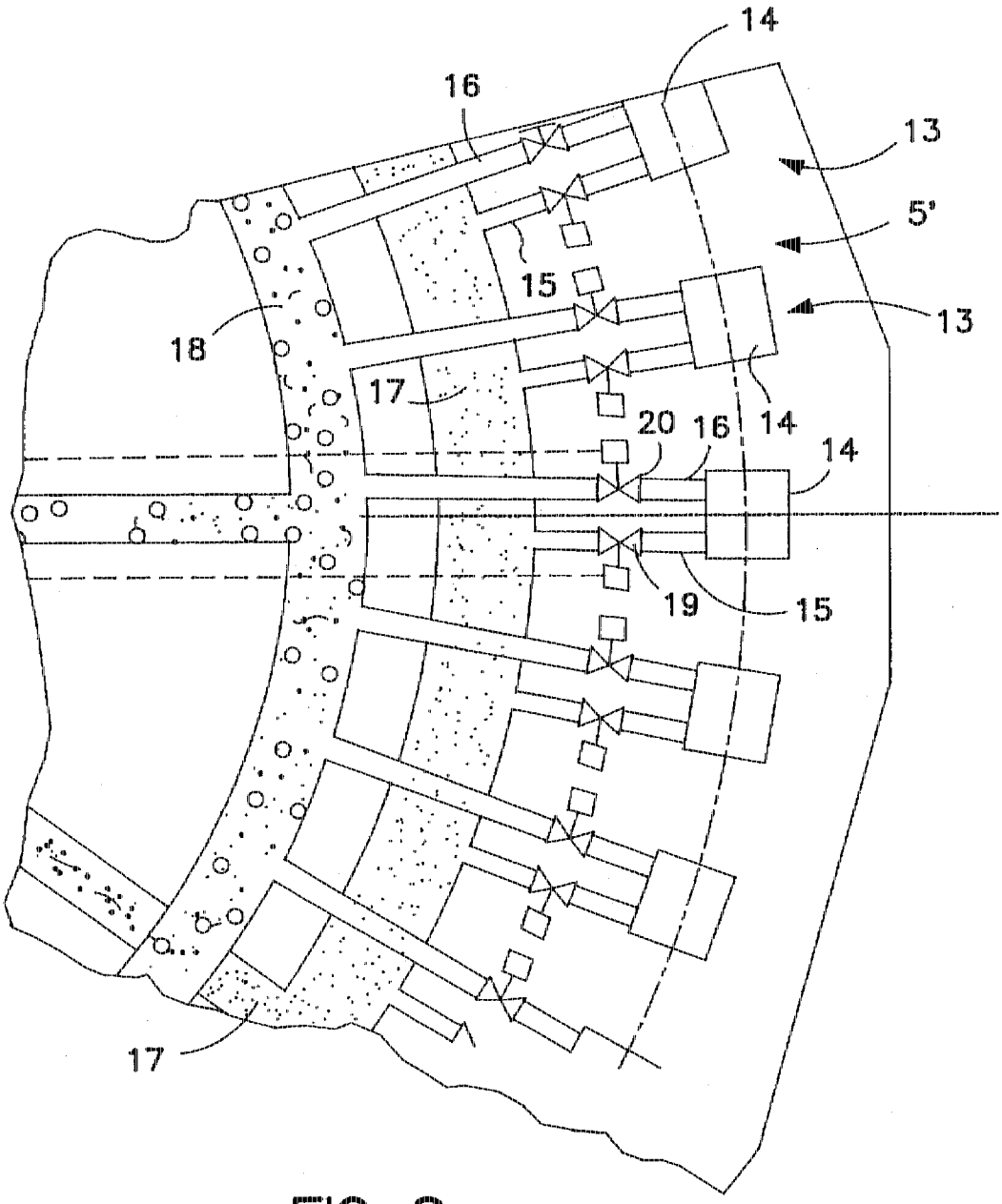
FIG. 2 is an enlarged detail of a portion of the rotor of the filling machine of the system illustrated in FIG. 1.

The filling machine 5 is preferably of the revolving design, with a rotor 5' which revolves around a vertical machine axis. On the periphery of the rotor 5' there are a number of filling positions 13, each of which consists, in the conventional manner which is not illustrated in any further detail, of bottle carriers or container carriers, as well as a filling element 14 (see FIG. 2) located above the respective container carrier. In contrast to known filling machines, each filling element 14 is preferably connected by means of two connections 15 and 16 to a toroidal vessel 17 which contains the first product (by means of the connection 15) and to a second toroidal vessel 18 which contains the second product (by means of the connection 16). Each filling element 14 also preferably has, at the connections, two individually-controllable fluid or control valves 19 and 20, so that in each bottle 2 which is delivered at the inlet of the filling machine 5 to a filling position 13, the first product or the second product can be filled by means of an appropriate control of the filling product or fluid valves.

The two toroidal vessels 17 and 18 are components of the revolving rotor 5'. Each toroidal vessel 17 and 18 can be connected by means of a rotary coupling and by means of an external connecting line 21 and 22, respectively, to an external reservoir or mixer 23 or 24, respectively, to supply the respective product (mixer 23 for the first product and mixer 24 for the second product). The valves 19 and 20 can be actuated individually by the control device 12 on the basis of a desired program (filling formation), and by an element on each filling position 13 or on each filling element 14 which measures the fill level.

Figure 2A:
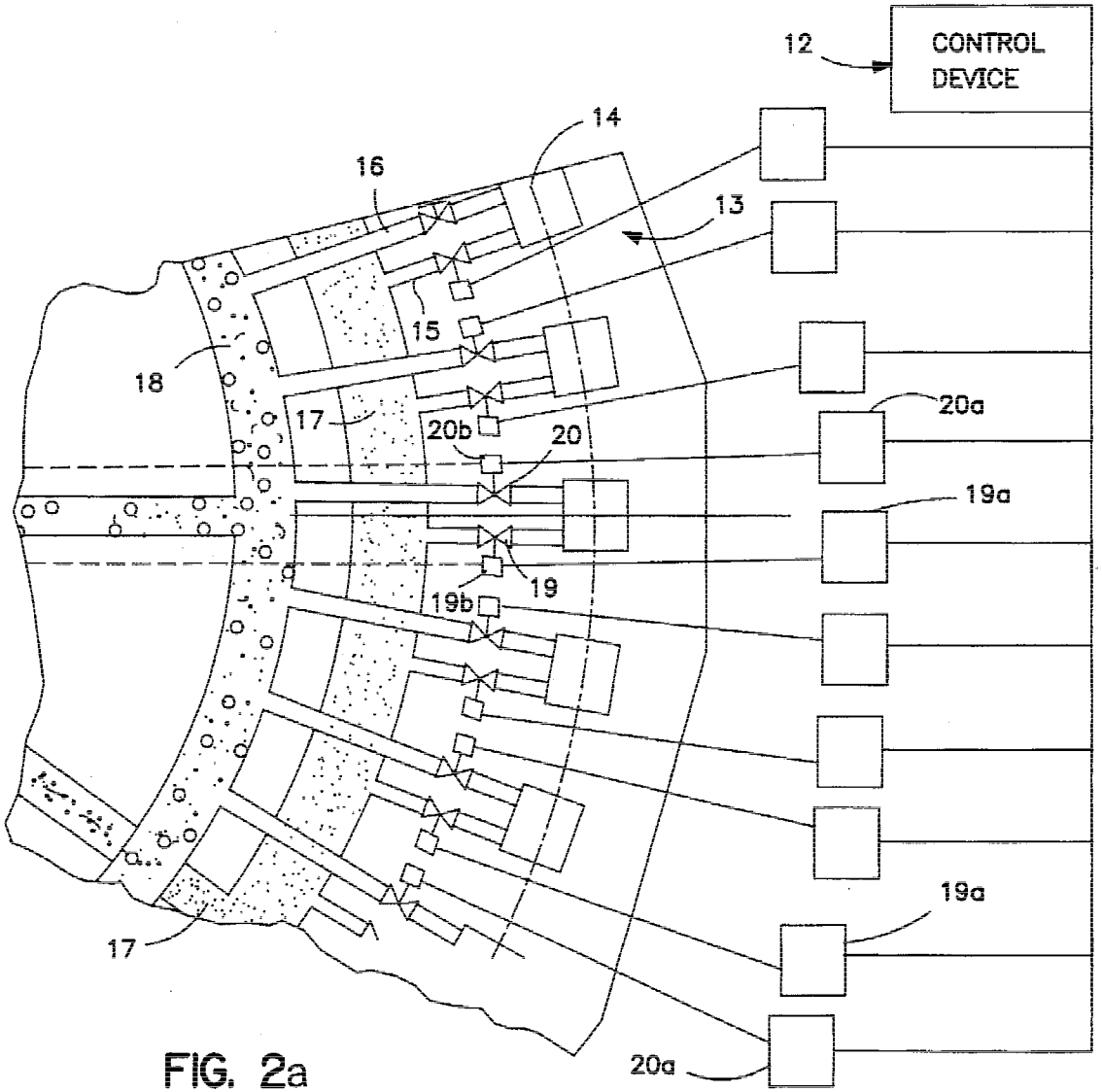
FIG. 2*a* is the same view as FIG. 2, but illustrating schematically a possible control relationship between the filling machine and a control device.

FIG. 2*a* illustrates a schematic representation of one embodiment of the present invention which shows how control device 12 could be operatively connected to each of the individual valves 19 and 20 by means of individual control units 19*a* and 20*a* being operatively connected to valve controllers 19*b* and 20*b*, respectively, on each valve. Each of these control units 19*a* and 20*a* can in turn be connected to and controlled by the control device 12. This allows control device 12 to control each filling element 14 separately, and to actuate either valve 19 or 20, depending on the pre-determined filling formation.

Closer 6

The closer 6 is preferably of the conventional construction, and is used to close the bottles 2 after they have been filled in the filling machine 5, for example, in the conventional manner with a cork closure, or with another suitable closure, and in particular regardless of what filling product or product the respective bottle 2 contains.

Labelling device 8

The labelling device 8 can have, on a revolving rotor 25, two individual labelling stations or units 26 and 27 which can be activated individually, each of which has its own label magazine 26' and 27'. For example, the unit 26 with the magazine 26' contains the labels corresponding to the first product, and the unit 27 with the magazine 27' contains the labels corresponding to the second product. Of course, each labelling station can also consist of a plurality of units, thereby producing an individual packaging for each product comprising a plurality of labels.

In the illustrated embodiment, the labelling device 8 also has an outlet star wheel 28, on which there preferably are electrically adjustable or controllable guide elements which act as "switches", so that the closed and labelled bottles 2 can be fed in a controlled manner to a conveyor belt or output 9–11. The labelling machine 8 or its functional elements, i.e. in particular the labelling stations 26 and 27 and the outlet star wheel 28 and its guide elements which act as switches, can be controlled by the control device 12.

The conveyor segments 9 and 10 can preferably lead to a packer 29. To essentially prevent gaps in the transport of the filled and labelled bottles 2 to this packer 29, which gaps are caused by the rejection of incorrectly filled and/or closed and/or labelled bottles 2, the conveyor lines 9 and 10 can form buffer zones.

Operation

The operation of the system is described below.

In accordance with the wishes expressed by the customer, each packaging unit 30 should contain a defined number of bottles 2 with the first and the second product after packaging. This desired assortment or formation is preferably entered into an input of the control device 12, so that then, when the filling process begins, the control device 12 and its process controller can control the valves 19 and 20 as a function of the specified filling formation, namely, so that as the rotor 5' revolves, a first group of filling positions 13 fill the bottles 2 located in them with the first product, and a second group of filling positions 13 fill the bottles 2 located in them with the second product, in a specified sequence or order. The process is preferably controlled so that during the entire filling process, i.e. until the filling machine 5 is shut down and cleaned, each filling position 13 is used during each revolution of the rotor 5' to dispense the same product, i.e. either to dispense the first product or to dispense the second product; in other words, there is no switching or changing of the individual filling positions 13 from one product to the other.

In the sequence defined by the actuation of the valves 19 and 20 regarding filling with the different products, the bottles 2, after they have been closed, travel via the conveyor line 7 to the labelling device 8.

The sequence imposed at the filling machine 5 of the bottles 2 filled with the different products, which is also called the filling formation, is transmitted by the control device 12 to the labelling device 8 which controls or activates the labelling units 26 and 27, namely so that there is a synchronization of the respective labelling unit and thus also of the packaging of each bottle 2 so that the label applied corresponds to the product the bottle contains. For those bottles 2 which are filled with the first product, the unit 26 is always activated, so that the bottles 2 are then provided with the packaging appropriate to the first product, and for those bottles 2 which are filled with the second product, the unit 27 is activated, so that these bottles 2 are then provided with the packaging appropriate to the second product. By means of the outlet star wheel 28, the bottles 2 are then sorted as a function of the product they contain, and are transported to the conveyor belt 9 or 10, or if they have been incorrectly filled, closed or labelled, they are transported to the conveyor belt 11.

Figure 1A:
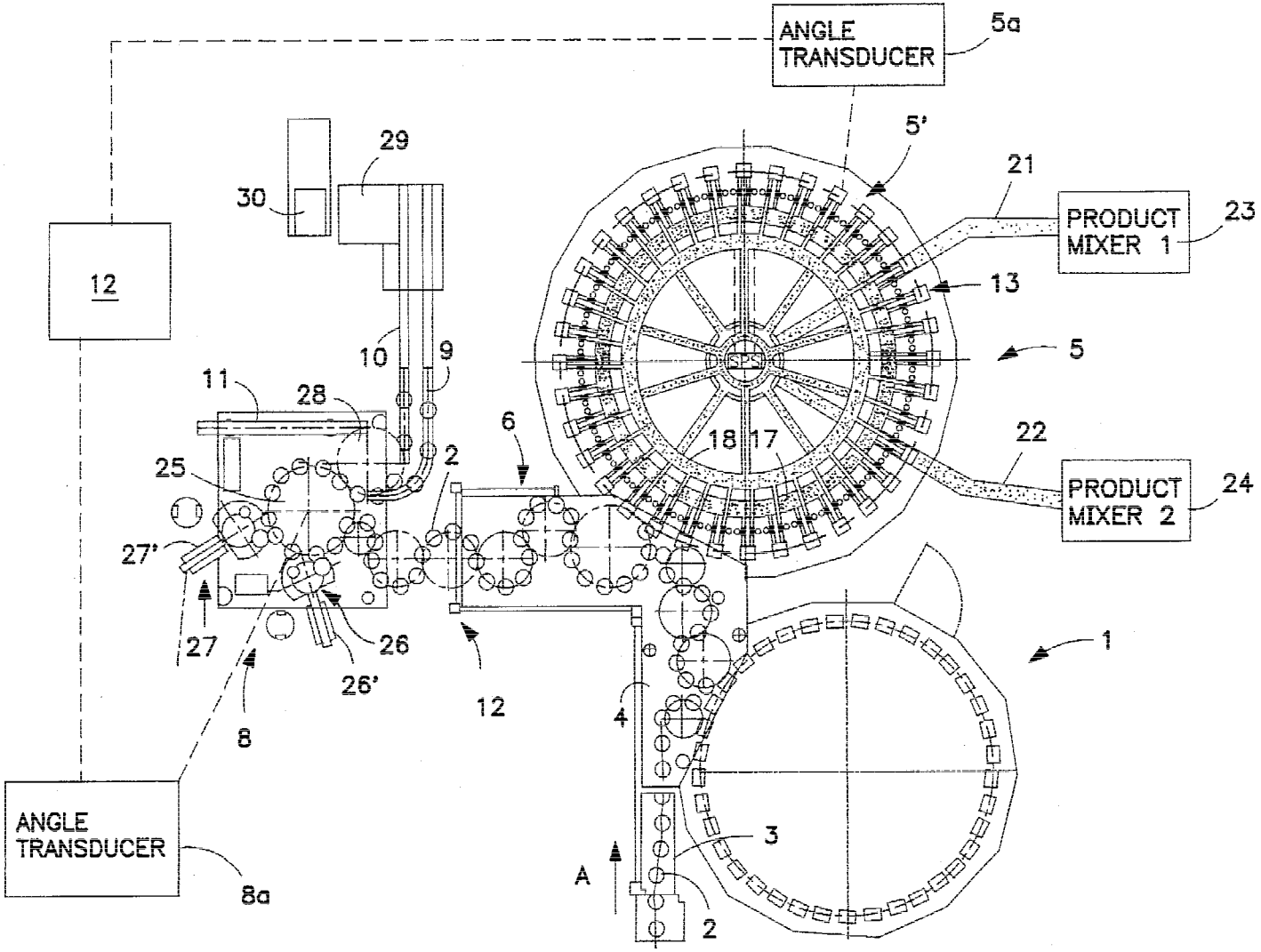
FIG. 1*a* is the same view as FIG. 1, but illustrating schematically a possible control relationship between a control device and angle tranducers.

FIG. 1*a* illustrates schematically one possible embodiment of the present invention wherein both the filling machine 5 and labelling device 8 each include a rotary angle transducer 5*a* and 8*a*, respectively. These angle tranducers 5*a*, 8*a* can be operatively connected to the control device 12, thereby allowing the control device 12 to monitor and regulate the rotating of the filling machine 5 and the labelling device 8 relative to one another.

At the packer 29, the groups of bottles which correspond to the desired formation are then formed from bottles which contain the first and second product, and are placed in the corresponding boxes 30.

Figure 3:
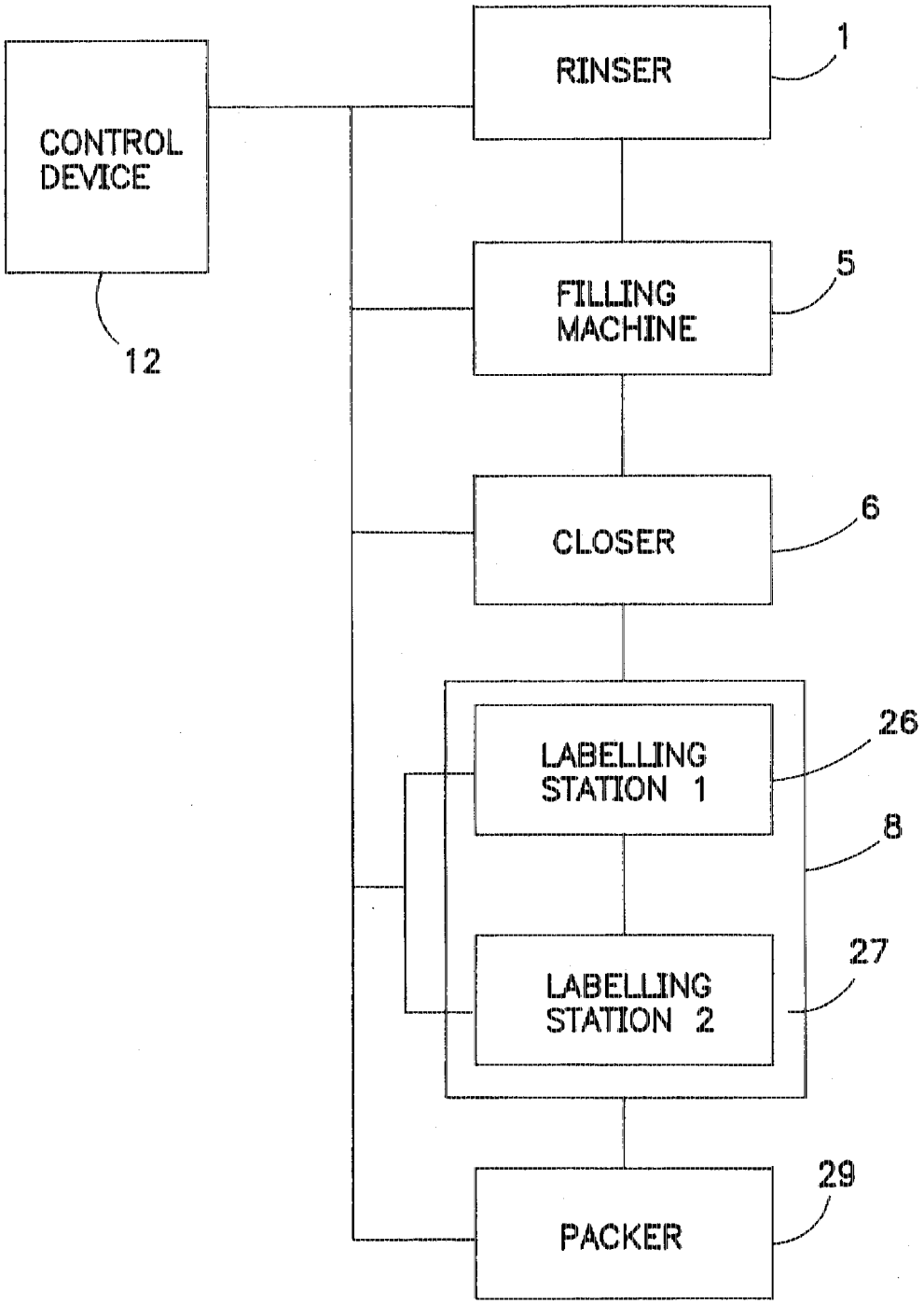
FIG. 3 is a schematic representation of the functioning of a control device in regard to one embodiment of the present invention.

FIG. 3 is a schematic representation of one possible way that control unit 12 can be operatively connected to the individual stations the bottles 2 pass through as they are conveyed along one embodiment of the present invention.

The invention was explained above on the basis of one embodiment. It should be understood that modifications and variations can be made to the invention without thereby going beyond the scope of the invention. For example, in a variant of the embodiment described above, it is possible, on the labelling device 8, to have a plurality of label magazines on a common labelling unit, which magazines are then activated by the control device as a function of the filling formation carried out by the filling machine, so that the correct labels and packaging can be used for each product. It also goes without saying that it is also possible to use containers other than bottles 2, e.g. cans.

One feature of the invention resides broadly in the method for filling bottles, cans or similar containers 2 with a liquid filling product using a filling machine 5 which has a revolving construction with, on the periphery of a rotor 5' which revolves around a vertical machine axis, a plurality of filling positions 13 for filling the containers with the filling product, each of which filling positions has a filling element 14 and a container carrier, a closer 6 located downstream of the filling machine 5 and a labelling device located downstream of the closer with at least one labelling station 26, 27, characterized by the fact that to fill the containers 2 with different filling products, i.e. optionally with at least a first or a second filling product according to a specified or selected filling formation, the filling machine is controlled by means of a control device 12 so that the filling positions 13 fill the different filling products into the appropriate containers 2 for each filling product, according to the filling formation.

Another feature of the invention resides broadly in the method characterized by the fact that during each full revolution of the rotor 5', different groups of filling positions 13 fill the different filling products into the appropriate containers for each filling product.

Yet another feature of the invention resides broadly in the method characterized by the fact that, under the control of the control device, the number of filling positions 13 of each group is defined by the filling formation selected or specified.

Still another feature of the invention resides broadly in the method characterized by the use of filling positions 13, each of which has at least one connection 15 for each product, as well as at least one valve device 19, 20, whereby, under the control of the control device 12, there is a switching between the connections 15, 16.

A further feature of the invention resides broadly in the method characterized by the fact that the at least one labelling station 26, 27 can be activated by the control device 12 for the labelling of the containers 2 in a manner corresponding to the filling formation, such that each container is provided with the label and packaging appropriate to the filling product it contains.

Another feature of the invention resides broadly in the method characterized by the fact that the labelling device 8 has at least two labelling stations 26, 27, and that the labelling stations 26, 27 are activated by the control device 12 as a function of the filling formation, and label each container with the label corresponding to its filling product.

Yet another feature Of the invention resides broadly in the method characterized by the fact that the at least one labelling station 26, 27 has at least two label magazines 26', 26', and that the label magazines 26', 27' are activated by the control device 12 as a function of the filling formation.

Still another feature of the invention resides broadly in the method characterized by the fact that the containers 2 containing different filling products are each fed to a separate output 9, 10 of the labelling device.

A further feature of the invention resides broadly in the method characterized by the fact that that the method is controlled by a computer-assisted central control device.

Another feature of the invention resides broadly in the method characterized by the fact that the containers 2 are transported from the closer 6 to the labelling device 8 by means of a conveyor line 7 which is formed exclusively by conveyor elements, preferably by star wheel conveyors which maintain the sequence and a specified distance between the containers during the transport from the closer 6 to the labelling device 8.

Yet another feature of the invention resides broadly in the system for filling bottles, cans or similar containers 22 with a liquid filling product, with a filling machine 5 which has a revolving construction with, on the periphery of a rotor 5' which revolves around a vertical machine axis, a plurality of filling positions 13 for filling the containers with the filling product, each of which filling positions has a filling element 14 and a container carrier, a closer 6 located downstream of the filling machine 5 and a labelling device located downstream of the closer with at least one labelling station 26, 27, characterized by the fact that to fill the containers 2 with different filling products, i.e. optionally with at least a first or a second filling product according to a specified or selected filling formation, the filling machine is controlled by means of a control device 12 so that the filling positions 13 fill the different filling products into the appropriate containers 2 for each filling product, according to the filling formation.

Still another feature of the invention resides broadly in the system characterized by the fact that as the rotor 5' revolves, the control device 12 controls different groups of filling positions 13 so that they dispense different filling products into containers 2 appropriate for each filling product.

A further feature of the invention resides broadly in the system characterized by the fact that, under the control of the control device, the number of filling positions 13 of each group is defined by the filling formation selected or specified.

Another feature of the invention resides broadly in the system characterized by the fact that each filling position 13 has at least two connections 15, 16 for different products, and that each filling position 13 or the filling element 14 located in that position has at least one valve device 19, 20 which, under the control of the control device 12, makes it possible to switch between the connections 15, 16.

Yet another feature of the invention resides broadly in the system characterized by the fact that the valve device is formed by at least two valves 19, 20 which can be controlled individually, e.g. two fluid valves 19, 20 which are actuated electromagnetically or pneumatically and are controlled electrically.

Still another feature of the invention resides broadly in the system characterized by the fact that on the rotor 5', there are at least two supply lines or supply reservoirs, e.g. closed circular pipelines or a toroidal vessel 17, 18, to which the connections 15, 16 are connected.

A further feature of the invention resides broadly in the system characterized by the fact that the at least one labelling station 26, 27 can be activated by the control device 12 to label the containers 2 in a manner which corresponds to the filling formation, such that each container is labelled with a label which corresponds to the filling product it contains.

Another feature of the invention resides broadly in the system characterized by the fact that the labelling device 8 has at least two labelling stations 26, 27 which are controlled by the control device 12 as a function of the filling formation, such that each container is labelled with a label which corresponds to the filling product it contains.

Yet another feature of the invention resides broadly in the system characterized by the fact that the at least one labelling station 26, 27 has at least two label magazines 26', 27' which are activated by the control device 12 as a function of the filling formation.

Still another feature of the invention resides broadly in the system characterized by the fact that the labelling device 8 has at least one separate output 9, 10 for each filling product or for the containers 2 filled with the respective filling products.

A further feature of the invention resides broadly in the system characterized by the fact that the labelling device 8, on a common rotor 25, has a discharge conveyor, e.g. formed by a star wheel conveyor 28, with at least one controllable guide and switch to steer the containers 2 to the output 9, 10 which corresponds to the respective contents.

Another feature of the invention resides broadly in the system characterized by the fact that the labelling device 8 has an additional output 11 for the removal or separation of incorrectly labelled containers 2.

Yet another feature of the invention resides broadly in the system characterized by the fact that the control device is a computer-assisted central control device.

Still another feature of the invention resides broadly in the system characterized by the fact that a conveyor line 7 which connects a closer 6 to the labelling device 8 is formed exclusively by transport elements, e.g. by star wheel conveyors which maintain the sequence and a specified distance between the containers during transport from the closer 6 to the labelling device 8.

A further feature of the invention resides broadly in the filling machine for filling bottles, cans or similar containers 2 with liquid filling product, which, on the periphery of a rotor 5' which circulates around a vertical machine axle has a plurality of filling positions 13 for filling the containers with the filling product, each of which filling positions has a filling element 14 and a container carrier, characterized by the fact that to fill the containers 2 according to a specified or selected filling formation optionally with at least a first or a second filling product, the filling machine is controlled by means of a control device 12 so that according to the filling formation, different filling positions 13 or groups of filling positions 13 dispense different filling products into suitable containers 2 for each filling product.

Another feature of the invention resides broadly in the filling machine characterized by the fact that, under the control of the control device, the number of filling positions 13 of each group is defined by the filling formation selected or specified during each revolution of the rotor 5'.

Yet another feature of the invention resides broadly in the filling machine characterized by the fact that each filling position 13 has at least two connections 15, 16 for different products, and that each filling position 13 or the filling element 14 located at each filling position has at least one valve device 19, 20, which is controlled by the control device 12 to make it possible to switch between the connections 15, 16.

Still another feature of the invention resides broadly in the filling machine characterized by the fact that the valve device is formed by at least two individually-controllable valves 19, 20, e.g. by two electromagnetically or pneumatically actuated and electrically controlled fluid valves 19, 20.

A further feature of the invention resides broadly in the filling machine characterized by the fact that on the rotor 5' there are at least two supply lines or reservoirs, e.g. closed circular pipelines or toroidal vessels 17, 18, to which the connections 15, 16 are connected.

Another feature of the invention resides broadly in the labelling machine with at least one labelling station 26, 27, characterized by the fact that to label containers which are filled in a specified or selected filling formation, each of which may be filled with a different filling product, and are transported in this formation to the labelling device, the at least one labelling station 26, 27 can be activated by a control device 12 to label the containers 2 in a manner which corresponds to the filling formations, so that each container is labelled with the label which corresponds to its contents.

Yet another feature of the invention resides broadly in the labelling machine characterized by the fact that the labelling device 8 has at least two labelling stations 26, 27, which are activated under the control of the control device 12 as a function of the filling formation, to label each container with a label which corresponds to the filling product it contains.

Still another feature of the invention resides broadly in the labelling device characterized by the fact that the at least one labelling station 26, 27 has at least two label magazines 26', 27', which are activated by the control device 12 as a function of the filling formation.

A further feature of the invention resides broadly in the labelling device characterized by the fact that the labelling device 8 has at least one separate output 9, 10 for each filling product or for the containers 2 filled with this filling product.

Another feature of the invention resides broadly in the labelling device characterized by the fact that the labelling device 8 has, on a common rotor 25, a discharge conveyor, e.g. a conveyor formed by a star wheel conveyor 28, with at least one controllable guide and switch to steer the container 2 to the output 9, 10 corresponding to the filling product contained in the respective containers.

Yet another feature of the invention resides broadly in the labelling device characterized by the fact that the labelling device 8 has an additional output 11 for the removal or rejection of incorrectly labelled containers 2.

Still another feature of the invention resides broadly in the labelling device characterized by the fact that a transport segment 7 which connects the closer 6 with the labelling device 8 is formed exclusively by transport elements, preferably by star wheel conveyors, which maintain the sequence as well as a specified interval between the containers during the transport from the closer 6 to the labelling device 8.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 13 064.2, filed on Apr. 7, 1995, having inventors Ludwig Clüsserath, Jean Marti, and Klaus-Werner Jung, and DE-OS 195 13 064.2 and DE-PS 195 13 064.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Examples of container labelling and/or filling machines and components thereof and/or accesories therefor may be found in the following documents: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like"; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Containter"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhseive Roller in a Labelling Machine"; U.S. Pat. No. 5,413,153 issued on May 9, 1995 and entitled "A Container Filling Machine for Filling Open-Top Containers, & A Filler Valve Therefor"; U.S. patent application Ser. No. 08/238,613 filed on May 5, 1994 entitled "Apparatus for Sorting Bottles or Similar Containers", having inventors Christoph WEISSENFELS and Manfred LONNIG, which corresponds to Federal Republic of Germany patent application No. P 43 15 038, filed May 6, 1993, which corresponds to DE-OS 43 15 038 and DE-PS 43 15 038; U.S. patent application Ser. No. 08/246,605 filed on May 20, 1994 entitled "Method & Arrangement for Converting A Single-Row Stream of Containers into a Multi-Row Stream of Containers", having inventor Heinz-Jurgen SCHERER, which corresponds to Federal Republic of Germany patent application No. P 43 17 069 filed on May 21, 1993, which corresponds to DE-OS 43 17 069 and DE-PS 43 17 069; U.S. patent application Ser. No. 08/310,239 filed on Sep. 21, 1994 entitled "Process & Apparatus for Cleaning Container Handling Machines such as Beverage Can Filling Machines", having inventors Klaus-Friedrich STOCK and Siegmar SINDERMANN, which corresponds to Federal Republic of Germany patent application No. P 43 32 202 filed on Sep. 22, 1993, which corresponds to DE-OS 43 32 202 and DE-PS 43 32 202; U.S. patent application Ser. No. 08/372674 filed on Jan. 16, 1995 entitled "Apparatus for Processing Containers Returned to Food & Beverage Producers for the Refilling of the Containers", having inventor Karl HEIDRICH, which corresponds to Federal Republic of Germany patent application No. P 42 23 427 filed on Jul. 16, 1992, which corresponds to DE-OS 42 23 427 and DE-PS 42 23 427, and International application No. PCT/DE93/00586 filed on Jul. 1, 1993, which corresponds to WO 94/02848; U.S. patent application Ser. No. 08/383,156 filed on Feb. 3, 1995 entitled "Apparatus for Processing Containers Returned to Food & Beverage Producers for the Refilling of the Containers", having inventors Rudiger STRAUCHMANN, Marten PETERS and Hubert GAISBAUER, which corresponds to Federal Republic of Germany patent application No. P 42 25 984 filed on Aug. 6, 1992, which corresponds to DE-OS 42 25 984 and DE-PS 42 25 984, and International application No. PCT/DE93/00692 filed Aug. 4, 1993, which corresponds to WO 94/03287; U.S. patent application Ser. No. 08/444,621 filed on May 19, 1995 entitled "Labelling Machine & Apparatus for the Automatic Loading of the Main Magazine of a Labelling Machine, & A Supply Magazine Which Can Be Used in Such an Apparatus" having inventor Rudolf ZODROW, which corresponds to Federal Republic of Germany patent application No. P 44 17 497 filed on May 19, 1994, which corresponds to DE-OS 44 17 497 and DE-PS 44 17 497; and U.S. patent application Ser. No. 08/517,159 filed on August 1995 entitled "Method for Bottling a Liquid in Bottles or Similar Containers" having inventors Ludwig CLUSSERATH and Manfred HARTEL, which corresponds to Federal Republic of Germany patent application No. P 44 29 594 filed Aug. 20, 1994, and which corresponds to DE-OS 44 29 594 and DE-PS 44 29 594. These patents and patent applications and their corresponding published patent applications, as well as their published equivalents, and other equivalents or corresponding applications, if any, and the publications recited in any of the documents, publications, patents, and published patent applications appearing or recited herein, are hereby incorporated by reference as if set forth in their entirety herein. All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; and U.S. Pat. No. 5,445,194, issued on Aug. 29, 1995 and entitled "Filling Element for Filling Machines for Dispensing a Liquid Filling Material into Containers."

Some additional examples of methods and apparatuses for closing bottles and containers and their components which may be incorporated in an embodiment of the present invention may be found in U.S. Pat. No. 5,402,623, issued on Apr. 4. 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

Some examples of computer systems and methods and their components which may be incorporated in an embodiment of the present invention are to be found in U.S. Pat. No. 5,379,428, entitled "Hardware Process Scheduler and Processor Interrupeter for Parallel Processing Computer Systems" and issued to Belo on Jan. 3, 1995; U.S. Pat. No. 5,398,333, entitled "Personal Computer Employing Reset Button to Enter ROM-based Diagnostics" and issued to Shieve and Finch on Mar. 14, 1995; U.S. Pat. No. 5,390,301, entitled "Method and Apparatus for Communicating Device-Specific Information Between a Device Driver and an Operating System in a Computer System" and issued to Scherf on Feb. 14, 2995; U.S. Pat. No. 5,404,544, entitled "System for Periodically Transmitting Signal to/from Sleeping Node Identifying its Existence to a Network and Awakening the Sleeping Node Responding to Received Instruction" and issued to Crayford on Apr. 4, 1995; U.S. Pat. No. 5,418,942, entitled "System and Method for Storing and Managing Information" and issued to Krawchuk on May 23, 1995; U.S. Pat. No. 5,479,355, entitled "System and Method for a Closed Loop Operation of Schematic Designs with Electrical Hardware" and issued to Hyduke on Dec. 26, 1995; and U.S. Pat. No. 5,428,790, entitled "Computer Power Management System" and issued to Harper, et al. on Jun. 27, 1995.

Examples of rotary position sensors and rotary position indicators, components thereof, and components associated therewith, which may be utilized in accordance with the embodiments of the present invention, may be found in the following U.S. Pat. Nos. 4,458,893, which issued to Rub on Jul. 10, 1984; No. 4,841,246, which issued to Juds and Beihoff on Jun. 20, 1989; No. 4,581,993, which issued to Schoneberger on Apr. 15, 1986; No. 4,360,889, which issued to Liedtke on Nov. 23, 1982; No. 5,222,457, which issued to Friedrich on Jun. 6, 1993; No. 4,899,643, which issued to Hvilsted and Pedersen on Feb. 13, 1990; No. 5,396,139, which issued to Surmely and Taghezout on Mar. 7, 1995; No. 5,419,195, which issued to Quinn on May 30, 1995; No. 5,424,632, which issued to Montagu on Jun. 13, 1995; No. 5,433,118, which issued to Castillo on Jul. 18, 1995; No. 5,442,329, which issued to Ghosh and DaSilva on Aug. 15, 1995; and No. 5,444,368, which issued to Horber on Aug. 22, 1995.

Some examples of switches or levers, or components thereof, which may be incorporated in an embodiment of the present invention are to be found in U.S. Pat. No. 5,392,895, entitled "Transfer Unit" and issued to Sorensen on Feb. 28, 1995; U.S. Pat. No. 5,404,992, entitled "Suspension Conveyor System" and issued to Robu and Enderlein on Apr. 11, 1995; U.S. Pat. No. 5,438,911, entitled "Control Cylinder for Pneumatic Control Devices with Signal Switches" and issued to Fiedler and Supanz on Aug. 8, 1995; U.S. Pat. No. 5,440,289, entitled "Combined Alarm System and Window Covering Assembly" and issued to Riordan on Aug. 8, 1995; and U.S. Pat. No. 5,462,245, entitled "Apparatus for Locking Moveable Switch Parts" and issued to Durchschlag on Oct. 31, 1995.

Some examples of sensors and switches which may be incorporated in an embodiment of the present invention are to be found in U.S. Pat. No. 5,379,023, entitled "Alarm System" and issued to Dalton on Jan. 3, 1995; U.S. Pat. No. 5,453,589, entitled "Microswitch with Non-enlarging, Sealed Electrical Connections" and issued to Mayer on Sep. 26, 1995; U.S. Pat. No. 5,453,590, entitled "Bistable Microswitch" and issued to Mayer on Sep. 26, 1995; U.S. Pat. No. 5,378,865, entitled "Multi-directional Shock Sensor" and issued to Reneau on Jan. 3, 1995; U.S. Pat. No. 5,408,132, entitled "Proximity Switch Operating in a Non-Contacting Manner" and issued to Fericean, et al. on Apr. 18, 1995; U.S. Pat. No. 5,428,253, entitled "Proximity Switch" and issued to Ogata and Onji on Jun. 27, 1995; 5,442,150, entitled "Piezo Electric Switch" and issued to Ipcinski on Aug. 15, 1995; U.S. Pat. No. 5,430,421, entitled "Reed Contactor and Process of Fabricating Suspended Tridemensional Metallic Microstructure" and issued to Bornand and Simon on Jul. 4, 1994; and U.S. Pat. No. 5,444,295, entitled "Linear Dual Switch Module" and issued to Lake et al. on Aug. 22, 1995.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

NOMENCLATURE

| | |
|---|---|
| 1 | Rinser |
| 2 | Bottle |
| 3, 4 | Conveyor line |
| 5 | Filling machine |
| 5' | Rotor |
| 5a | Angle Transducer |
| 6 | Closer |
| 7 | Conveyor line |
| 8 | Labelling device |
| 8a | Angle Transducer |
| 9–11 | Conveyor line |
| 12 | Control device |
| 13 | Filling position |
| 14 | Filling element |
| 15, 16 | Connection |
| 17, 18 | Toroidal vessel |
| 19, 20 | Valve |
| 19a, 20a | control unit |
| 19b, 20b | valve controllers |
| 21, 22 | External supply line |
| 23, 24 | Mixer |
| 25 | Rotor |
| 26, 27 | Labelling station |
| 26', 27' | Label magazine |
| 28 | Outlet star wheel |
| 29 | Packer |
| 30 | Packaging unit (e.g. box) |

What is claimed is:

1. Method for filling containers with liquid filling products utilizing a filling machine having a revolving construction with a plurality of filling positions for filling the containers with the filling product on the periphery of a rotor which revolves around a vertical machine axis, each of the filling positions having a filling element and a container carrier, at least two liquid filling products, and a control device; said method comprising the steps of:

feeding the bottles into the filling machine;

moving each container into one of the plurality of filling positions;

entering data into a control device to provide a filling formation, defining the sequence in which the containers are to be filled with one of each of said at least two liquid filling products, to result in a predetermined packaging unit formation;

controlling with the control device which one of the at least two liquid filling products is to be released into each of the containers at each filling position in accordance with the filling formation; and filling each container with its designated one of the at least two liquid filling products.

2. The method for filling containers with a liquid filling machine according to claim 1, wherein the at least two liquid filling products comprise a first liquid filling product and a second liquid filling product, wherein:

said step of controlling with the control device further comprises the steps of:

designating at least two groups comprising at least a first group and a second group of said filling positions;

assigning each said filling position into one of said at least a first group and a second group during each full revolution of the rotor; and maintaining each said filling position in each said assigned group in a subsequent revolution of said rotor; said method for filling further comprises the steps of:

dispensing said first liquid filling product at said first group; and dispensing said second liquid filling product at said second group.

3. The method for filling containers with a liquid filling machine according to claim 2, wherein said step of controlling by means of a control device further comprises defining the number of said filling positions assigned to each said group by the desired filling formation.

4. The method for filling containers with a liquid filling machine according to claim 3, wherein the liquid filling machine utilized further comprises separate connections at each of the filling positions for each of said at least two filling products, each connection having at least one corresponding valve device, and wherein a closer is located downstream of the filling machine, and a labelling device with at least one labelling station is located downstream of the closer; said method further comprising:

said step of filling each container further comprises switching between the respective connections for each of said at least two filling products at each filling position by operating at least one corresponding valve device;

said step of controlling by means of a control device comprises:

controlling the switching between the connections;

activating at least one labelling station; and said method for filling containers with a liquid filling machine further comprises the step of labelling the containers in a manner corresponding to the filling formation, such that each container is provided with a label and packaging corresponding to the filling product it contains.

5. The method for filling containers with a liquid filling machine according to claim 4, further comprising the steps of:

labelling the containers with a labelling device having at least two labelling stations;

said step of controlling by means of a control device comprises:

activating and controlling the labelling stations as a function of the filling formation such that each container receives a label corresponding to its filling product; and utilizing at least one labelling station having at least one label magazine which is activated by the control device as a function of the filling formation.

6. The method for filling containers with a liquid filling machine according to claim 5, further comprising the steps of:

feeding to separate outputs of the labelling device the containers containing different filling products;

said step of controlling by means of a control device comprises controlling by a computer-assisted central control device; and transporting containers from the closer to the labelling device by means of a conveyor line comprising star wheel conveyors which substantially maintain the sequence and a specified distance between the containers during the transport from the closer to the labelling device.

7. A system for filling containers with at least two liquid filling products, said system comprising:

a filling machine;

said filling machine defining a vertical axis;

said filling machine comprising:

a rotor disposed to revolve around said axis;

said rotor having a periphery;

a plurality of filling positions disposed about said periphery;

said filling positions comprising a filling element and a container carrier;

apparatus to hold said at least two liquid filling products;

an arrangement for supplying said at least two liquid filling products from said holding apparatus to its corresponding filling position;

said supplying arrangement comprising:

two conduits corresponding to said at least two liquid filling products being connected to said holding apparatus;

said conduits being connected to at least one valve to control the flow of said at least two liquid filling products;

said at least one valve being connected to its corresponding filling element;

a closing unit for closing the containers disposed downstream from said filling machine;

a labelling unit for labelling the containers disposed downstream from said closing unit;

said labelling unit comprising at least one labelling station;

means for providing a filling formation defining the sequence in which the containers are to be filled with one of each of said at least two liquid filling products, to result in a predetermined packaging unit formation; and means for controlling which one of the at least two liquid filling products is to be released into each of said containers at each one of said filling positions in accordance with said filling formation.

8. The system according to claim 7, wherein:

said at least two liquid filling products comprises a first liquid filling product and a second liquid filling product;

said control means comprises:

means for designating at least two groups comprising at least a first group and a second group of said filling positions;

means for assigning each said filling position into one of said at least a first group and a second group during each full revolution of the rotor;

said first liquid filling product is dispensed at said first group;

said second liquid filling product is dispensed at said second group; and each said filling position being in each said assigned group in a subsequent revolution of said rotor.

9. The system according to claim 8, wherein said control means defines the number of said filling positions of each said group based on said filling formation.

10. The system according to claim 9, wherein said at least one valve is controlled by said control means.

11. The system according to claim 10 wherein said control means comprises means for activating said at least one labelling station in accordance with said filling formation, to label said containers with a label which corresponds to the filling product contained therein.

12. The system according to claim 11 wherein:

said at least one labelling station comprises at least two labelling stations;

each of said at least two labelling stations comprises at least one label magazine; and said control means comprises means for activating said at least one label magazine as a function of said filling formation.

13. The system according to claim 12, wherein:

said at least one valve comprises at least two valves configured for being controlled individually; and said valves being controlled electrically and being actuated one of: electromagnetically and pneumatically.

14. The system according to claim 13, wherein:

said holding apparatus comprises at least two substantially torodial vessels disposed on said rotor;

each said vessel containing one of said at least two liquid filling products;

said two conduits each connecting one of said vessels to their corresponding filling position;

said labelling unit further comprises two separate outputs;

one of said two separate outputs corresponding to one of said at least two liquid filling products;

the other of said two separate outputs corresponding to another one of said at least two liquid filling products;

said labelling unit further comprises conveyor discharge means for guiding and steering the containers to one of said two separate outputs depending on the content of each of the containers;

said labelling unit has an additional output for the removal and separation of incorrectly labelled ones of said containers;

said control means comprises a computer-assisted central control device; and said system further comprises a conveyor line disposed to connect said closing unit with said labelling unit;

said conveyor line comprising transport elements; and said transport elements comprising at least one star wheel conveyor for maintaining the sequence and a specified distance between said containers during transport from said closer unit to the labelling unit.

15. A filling machine for filling containers with at least two liquid filling products, said filling machine comprising:

a revolving rotor;

a vertical machine axle;

said machine axle defining an axis of rotation;

said rotor revolving around said axis of rotation;

said rotor having a periphery;

a plurality of filling positions disposed about said periphery;

each of said filling positions comprising a filling element and a container carrier;

apparatus to hold said at least two liquid filling products;

an arrangement for supplying said at least two liquid filling products from said holding apparatus to its corresponding filling position;

said supplying arrangement comprising:

two conduits corresponding to said at least two liquid filling products being connected to said holding apparatus;

said conduits being connected to at least one valve to control the flow of said at least two liquid filling products;

said at least one valve being connected to its corresponding filling element;

means for providing a filling formation defining the sequence in which the containers are to be filled with one of each of said at least two liquid filling products, to result in a predetermined packaging unit formation; and means for controlling which one of said at least two liquid filling products is dispensed into containers for each corresponding product at each corresponding filling position, in accordance with said predetermined filling formation.

16. The filling machine according to claim 15, wherein said control means defines for each revolution of said rotor, the number of said filling positions dispensing a particular filling product in accordance with said filling formation; and said control means comprises a control device.

17. The filling machine according to claim 16, wherein said control device comprises means for controlling said at least one valve.

18. The filling machine according to claim 17, wherein:

said at least one valve comprises at least two valves;

said at least two valves being configured for being individually controllable;

said at least two valves being electrically controlled and actuated one of: electromagnetically and pneumatically;

said holding apparatus comprises at least two substantially torodial vessels disposed on said rotor;

each said vessel containing one of said at least two liquid filling products; and said two conduits each connecting one of said vessels to their corresponding filling position.

* * * * *

UNITED STATES PATENT AND TRADEMARK OFFICE

CERTIFICATE OF CORRECTION

PATENT NO. : 5,713,403

DATED : February 3, 1998

INVENTOR(S) : Ludwig CLÜSSERATH, Jean MARTI and Klaus-Werner JUNG

It is certified that error appears in the above-identified patent and that said Letters Patent is hereby corrected as shown below:

In column 12, line 28, after 'to', delete "Rub" and insert --Ruh--.

Signed and Sealed this

Second Day of June, 1998

Bruce Lehman

*Attest:*

BRUCE LEHMAN

*Attesting Officer*

*Commissioner of Patents and Trademarks*